US011214750B2

(12) United States Patent
Milner

(10) Patent No.: US 11,214,750 B2
(45) Date of Patent: Jan. 4, 2022

(54) COMBINATIONS OF PHOSPHOROUS-CONTAINING COMPOUNDS FOR USE AS ANTI-WEAR ADDITIVES IN LUBRICANT COMPOSITIONS

(71) Applicant: Afton Chemical Corporation, Richmond, VA (US)

(72) Inventor: Jeffrey L. Milner, Chesterfield, VA (US)

(73) Assignee: AFTON CHEMICAL CORPORATION, Richmond, VA (US)

( * ) Notice: Subject to any disclaimer, the term of this patent is extended or adjusted under 35 U.S.C. 154(b) by 0 days.

(21) Appl. No.: 15/704,611

(22) Filed: Sep. 14, 2017

(65) Prior Publication Data

US 2018/0002631 A1 Jan. 4, 2018

Related U.S. Application Data

(63) Continuation of application No. 12/840,386, filed on Jul. 21, 2010, now abandoned.

(60) Provisional application No. 61/235,520, filed on Aug. 20, 2009.

(51) Int. Cl.

| | |
|---|---|
| ***C10M 141/10*** | (2006.01) |
| ***C10M 137/00*** | (2006.01) |
| ***C10N 30/06*** | (2006.01) |
| ***C10N 30/12*** | (2006.01) |
| ***C10N 30/00*** | (2006.01) |
| ***C10N 40/04*** | (2006.01) |
| ***C10N 40/12*** | (2006.01) |
| ***C10N 40/25*** | (2006.01) |
| ***C10N 40/26*** | (2006.01) |
| ***C10N 40/28*** | (2006.01) |

(52) U.S. Cl.

CPC ..... *C10M 141/10* (2013.01); *C10M 137/00* (2013.01); *C10M 2215/04* (2013.01); *C10M 2215/06* (2013.01); *C10M 2215/08* (2013.01); *C10M 2215/086* (2013.01); *C10M 2217/043* (2013.01); *C10M 2223/043* (2013.01); *C10M 2223/047* (2013.01); *C10N 2030/06* (2013.01); *C10N 2030/12* (2013.01); *C10N 2030/42* (2020.05); *C10N 2040/04* (2013.01); *C10N 2040/042* (2020.05); *C10N 2040/044* (2020.05); *C10N 2040/045* (2020.05); *C10N 2040/046* (2020.05); *C10N 2040/12* (2013.01); *C10N 2040/25* (2013.01); *C10N 2040/255* (2020.05); *C10N 2040/26* (2013.01); *C10N 2040/28* (2013.01)

(58) Field of Classification Search

CPC ..... C10M 141/10; C10M 137/00; C10M 2215/04; C10M 2215/06; C10M 2215/08; C10M 2215/086; C10M 2217/043; C10M 2223/043; C10M 2223/047; C10N 2030/06; C10N 2030/12; C10N 2030/42; C10N 2040/04; C10N 2040/042; C10N 2040/044; C10N 2040/045; C10N 2040/046; C10N 2040/12; C10N 2040/25; C10N 2040/255; C10N 2040/26; C10N 2040/28

See application file for complete search history.

(56) References Cited

U.S. PATENT DOCUMENTS

| | | | | |
|---|---|---|---|---|
| 3,197,405 | A * | 7/1965 | Le Suer | C07F 9/165 252/400.21 |
| 3,197,496 | A | 7/1965 | LeSuer | |
| 4,431,552 | A | 2/1984 | Salentine | |
| 4,435,338 | A | 3/1984 | Michaelis et al. | |
| 5,403,501 | A * | 4/1995 | Schwind | C10M 163/00 508/186 |
| 5,500,140 | A | 3/1996 | Hughes et al. | |
| 2002/0160922 | A1 | 10/2002 | Milner | |
| 2007/0225182 | A1 * | 9/2007 | Hewette | C10M 137/12 508/564 |

OTHER PUBLICATIONS

FVA-Information Sheet, Research Project No. 2/IV Pitting Test; Forschungsvereinigung Antriebstechnike.V. Lyoner Strabe 18, 60498 Frankfurt, Jul. 1997, 10 pages.

* cited by examiner

*Primary Examiner* — James C Goloboy

(74) *Attorney, Agent, or Firm* — Barnes & Thornburg LLP

(57) ABSTRACT

The present disclosure relates to a lubricant composition comprising a first phosphorus compound, a second phosphorus compound, and a third phosphorus compound, wherein the first phosphorus compound is present in the lubricant composition in an amount to provide between about 120 and 350 ppm phosphorus. The lubricant composition may provide robust anti-wear and reduced pitting.

16 Claims, No Drawings

COMBINATIONS OF PHOSPHOROUS-CONTAINING COMPOUNDS FOR USE AS ANTI-WEAR ADDITIVES IN LUBRICANT COMPOSITIONS

CROSS REFERENCE TO RELATED APPLICATIONS

This application is a Continuation Application of U.S. application Ser. No. 12/840,386, filed Jul. 21, 2010, which claims priority to U.S. Provisional Application No. 61/235,520, filed Aug. 20, 2009.

TECHNICAL FIELD

This disclosure relates to lubricant additives and their combinations that may be used in a lubricating fluid to provide robust anti-wear characteristics without sacrificing anti-pitting performance. The disclosure also relates to the preparation of the lubricant additives and concentrates containing the lubricant additives, as well as devices lubricated with a lubricating fluid that includes the lubricant additives.

BACKGROUND

Lubricating compositions are used to prevent damage to machinery under operating conditions. In particular, under boundary lubricating conditions, a lubricant must act to minimize harmful metal-to-metal contact. Lubricant additive chemistry is useful at providing protection under boundary lubricating conditions but sometimes these additives adversely affect other performance characteristics. For example, a lubricant may be able to provide an array of surface fatigue protection, e.g., ridging, rippling, spalling, etc., but have a deleterious impact on other types of surface fatigue, such as pitting. It is desirable, therefore, to provide a combination of additives that can provide both excellent traditional anti-wear performance and good anti-pitting performance. In particular, there is needed a lubricant composition that can provide improved anti-wear as evidenced by automotive screening tests such as the High Temperature L-37 test as well as improved pitting performance as evidenced by the FZG Pitting Test.

It has now been discovered that certain combinations of additive chemistry as described below may be readily formulated into lubricating compositions to afford a unique solution for providing these desired lubricant performance characteristics.

SUMMARY

The present disclosure describes a novel lubricant composition that may meet the anti-wear and anti-pitting requirements of Original Equipment Manufacturers (OEMs) worldwide, including the U.S., Europe, and Asia, as well as service fill applications.

One embodiment of the present invention describes a lubricant composition comprising a first phosphorus compound formed by reacting an O,O-dihydrocarbyl phosphorodithioic acid with an epoxide to form a product, reacting the product with phosphorus pentoxide to produce an acid phosphate intermediate and neutralizing at least a major portion of the intermediate with at least one first amine and a second phosphorus compound formed by reacting a sulfur source with a dihydrocarbyl phosphite and a third phosphorus compound formed by reacting an acid phosphate with at least one second amine wherein the first phosphorus compound is present in the lubricant composition to provide between about 120 and about 350 ppm phosphorus to the lubricant composition and the first and second amine may be the same or different.

In another embodiment, the total amount of phosphorus present in the lubricant composition is between about 500 and about 1500 ppm.

In another embodiment, the total amount of phosphorus present in the lubricant composition is between about 800 and about 1100 ppm.

In some embodiments, the O,O-di-hydrocarbyl phosphorodithioic acid is O,O-di(4-methyl-2-pentyl) phosphorodithioic acid.

In other embodiments, the O,O-di-hydrocarbyl phosphorodithioic acid is 0,0'-di-n-hexylphosphorodithioic acid.

In some embodiments, the epoxide is selected from the group consisting of: ethylene oxide, propylene oxide, styrene oxide, alpha-methylstyrene oxide, p-methyl-styrene oxide, cyclohexene oxide, cyclopentene oxide, dodecene oxide, octadecene oxide, 2,3-butene oxide, 1,2-butene oxide, 1,2-octene oxide, 3,4-pentene oxide, and 4-phenyl-1,2-cyclohexene oxide.

In some embodiments, the first amine is selected from the group consisting of: aliphatic amines, aromatic amines, cyclo-aliphatic amines, heterocyclic amines, and carboxylic amines.

In some embodiments the first amine is a mixture of $C_{11}$-$C_{14}$ tertiary alkyl primary amines.

In some embodiments, the amine is an aliphatic amine selected from the group consisting of: tert-octyl amine, tert-dodecyl amine, tert-tetradecyl amine, tert-octadecyl amine, cetyl amine, behenyl amine, stearyl amine, eicosyl amine, docosyl amine, tetracosyl amine, hexatriacontanyl amine, pentahexacontanyl amine, cyclohexyl amine, n-hexylamine, dodecylamine, di-dodecylamine, tri-dodecylamine, N-methyl-octylamine, butylamine, oleyl amine, myristyl amine, N-dodecyl trimethylene diamine, aniline, o-toluidine, benzidine, phenylene diamine, N,N'-di-sec-butylphenylene diamine, beta-naphthylamine, alpha-naphthylamine, morpholine, piperazine, methane diamine, cyclopentyl amine, ethylene diamine, hexamethylene tetramine, octamethylene diamine, and N,N'-dibutylphenylene diamine.

In some embodiments, the amine is a hydroxy-substituted amine selected from the group consisting of: ethanolamine, diethanolamine, triethanolamine, isopropanolamine, para-aminophenol, 4-amino-naphthol-1,8-amino-naphthol-1, beta-aminoalizarin, 2-amino-2-ethyl-1,3-propandiol, 4-amino-4'-hydroxy-diphenyl ether, 2-amino-resorcinol, N-4-hydroxybutyl-dodecyl amine, N-2-hydroxyethyl-n-octylamine, N-2-hydroxypropyl dinonylamine, N,N-di-(3-hydroxypropyl)-tert-dodecyl amine, N-hydroxytriethoxyethyl-tert-tetradecyl amine, N-2-hydroxyethyl-tert-dodecyl amine, N-hydroxyhexapropoxypropyl-tert-octadecyl amine, and N-5-hydroxypentyl di-n-decyl amine.

In some embodiments, the dihydrocarbyl phosphite is dibutyl hydrogen phosphite.

In other embodiments, the dihydrocarbyl phosphite is selected from the group consisting of dilauryl hydrogen phosphite, dibutyl hydrogen phosphite and dioleyl phosphite.

In some embodiments, the sulfur source is selected from the group consisting of elemental sulfur, sulfurized isobutylene, and polysulfide.

In some embodiments, the acid phosphate is selected from the group consisting of a mono-hydrocarbyl acid phosphate, a di-hydrocarbyl phosphate, or a mixture of mono-hydrocarbyl acid phosphate and di-hydrocarbyl acid phosphate.

In some embodiments, the acid phosphate is selected from the group consisting of amyl acid phosphate, bis-2-ethylhexyl acid phosphate, and diamyl acid phosphate.

In some embodiments, the lubricant composition further comprises a major amount of base oil.

In some embodiments, the lubricant composition further comprises an oil-soluble ashless dispersant selected from the group consisting of succinimide dispersant, succinic ester dispersant, succinic ester-amide dispersant, Mannich base dispersant, phosphorylated forms thereof, and boronated forms thereof.

In some embodiments, the lubricant composition further comprises one or more of the following an air expulsion additive, an antioxidant, a corrosion inhibitor, a foam inhibitor, a metallic detergent, an organic phosphorus compound, a seal-swell agent, a viscosity index improver, and an extreme pressure additive.

In another embodiment, the invention includes a method of lubricating a machine part comprising lubricating the machine part with a lubricant composition comprising a first phosphorus compound formed by reacting an O,O-dihydrocarbyl phosphorodithioic acid with an epoxide to form a product, reacting the product with phosphorus pentoxide to produce an acid phosphate intermediate and neutralizing at least a major portion of the intermediate with at least one first amine and a second phosphorus compound formed by reacting a sulfur source with a dihydrocarbyl phosphite and a third phosphorus compound formed by reacting an acid phosphate with at least one second amine and wherein the first phosphorus compound is present in the lubricant composition to provide between about 120 and about 350 ppm phosphorus to the lubricant composition and the first and second amine may be the same or different.

In some embodiments, the machine part comprises a gear, an axle, a differential, an engine, a crankshaft, a transmission, or a clutch.

In some embodiments, the transmission is selected from the group consisting of an automatic transmission, a manual transmission, an automated manual transmission, a semi-automatic transmission, a dual clutch transmission, a continuously variable transmission, and a toroidal transmission.

In some embodiments, the clutch includes a continuously slipping torque converter clutch, a slipping torque converter clutch, a lock-up torque converter clutch, a starting clutch, one or more shifting clutches, or an electronically controlled converter clutch.

In some embodiments, the gear is selected from the group consisting of an automotive gear, a stationary gearbox, and an axle.

In some embodiments, the gear is selected from the group consisting of a hypoid gear, a spur gear, a helical gear, a bevel gear, a worm gear, a rack and pinion gear, a planetary gear set, and an involute gear.

In some embodiments, the differential is selected from the group consisting of a straight differential, a turning differential, a limited slip differential, a clutch-type limited slip differential, and a locking differential.

In some embodiments, the engine is selected from the group consisting of an internal combustion engine, a rotary engine, a gas turbine engine, a four-stroke engine, and a two-stroke engine.

In some embodiments, the engine includes a piston, a bearing, a crankshaft, and/or a camshaft.

Another embodiment, includes a method for testing the lubricant properties of a composition using a testing apparatus comprising lubricating the testing apparatus with a lubricant composition comprising a first phosphorus compound formed by reacting an O,O-dihydrocarbyl phosphorodithioic acid with an epoxide to form a product reacting the product with phosphorus pentoxide to produce an acid phosphate intermediate and neutralizing at least a major portion of the intermediate with at least one first amine and a second phosphorus compound formed by reacting a sulfur source with a dihydrocarbyl phosphite and a third phosphorus compound formed by reacting an acid phosphate with at least one second amine and wherein the first phosphorus compound is present in the lubricant composition to provide between about 120 and about 350 ppm phosphorus to the lubricant composition and the first and second amine may be the same or different, and the testing apparatus is selected from the group consisting of a Brookfield viscometer, any Vickers Test apparatus, an SAE No. 2 friction test machine, an electric motor-driven Hydra-Matic 4L60-E automatic transmission, ASTM D 471 or D 676 Elastomer Compatibility test equipment, NOACK volatility procedure machine, any test apparatus necessary for ASTM D 2882, D 5182, D 4172, D3233, and D2782 Wear Procedures, ASTM Foaming Procedure apparatus, test apparatus necessary for ASTM D 130 Copper Corrosion test, test equipment specified by the International Harvester Procedure Method BT-9 Rust Control test, test apparatus required by ASTM D 892 Foaming test, test apparatus required by ASTM D 4998 Gear Anti-Wear Performance test, Link M1158 Oil/Friction Machine, L-33-1 Test Apparatus, L-37 Test Apparatus, L-42 Test Apparatus, L-60-1 Test Apparatus, Strama 4-Square Electric Motor-Driven Procedure Machine, FZG Test Apparatus and parts, SSP-180 Procedure Machine, test apparatus for ASTM D 5579 High Temperature Cyclic Durability Procedure, Sauer-Danfoss Series 22 or Series 90 Axial Piston Pump, John Deere Synchro-Plus transmission, an SRV-friction wear tester, a 4-ball test apparatus, an LFW-1 test apparatus, a sprag clutch over-running wear test (SCOWT) apparatus, API CJ-4 engine tests, L-33 Moisture Corrosion Test, High-Temperature Cyclic Durability Test (ASTM D 5579), 288-hour VE engine oil performance test, L-38 standard lubricant test, Denison P46 Piston Pump Test Stand, Sundstrand Dynamic Corrosion Test Stand, a block-on-ring test apparatus, and any test apparatus required for performing test analysis under Mercon®, Mercon® V, Dexron® III, Dexron® III-H, Caterpillar® TO-4, Allison® C-4, JASO, GF-4, GF-5, MIL-E, MIL-L, and Sequences II through VIII.

In yet another embodiment, the invention includes a method for improving the anti-wear properties of a lubricating fluid by including in a lubricating fluid an effective amount of a lubricant composition comprising a first phosphorus compound formed by reacting an O,O-dihydrocarbyl phosphorodithioic acid with an epoxide to form a product, reacting the product with phosphorus pentoxide to produce an acid phosphate intermediate and neutralizing at least a major portion of the intermediate with at least one first amine and a second phosphorus compound formed by reacting a sulfur source with a dihydrocarbyl phosphite and a third phosphorus compound formed by reacting an acid phosphate with at least one second amine and wherein the first phosphorus compound is present in the lubricant composition to provide between about 120 and about 350 ppm phosphorus to the lubricant composition and the first and second amine are the same or different.

In yet another embodiment, the invention includes a method for improving the anti-wear and pitting properties of a lubricating fluid while lubricating an automotive component requiring lubrication, comprising adding a lubricating fluid to an automotive component requiring lubrication, the fluid comprising a base oil and a lubricant composition comprising a first phosphorus compound formed by reacting an O,O-dihydrocarbyl phosphorodithioic acid with an epoxide to form a product, reacting the product with phosphorus pentoxide to produce an acid phosphate intermediate and neutralizing at least a major portion of the intermediate with at least one first amine and a second phosphorus compound formed by reacting a sulfur source with a dihydrocarbyl phosphite and a third phosphorus compound formed by reacting an acid phosphate with at least one second amine and wherein the first phosphorus compound is present in the lubricant composition to provide between about 120 and about 350 ppm phosphorus to the lubricant composition and the first and second amine are the same or different and operating the automotive component that contains the fluid.

In some embodiments, the anti-wear and pitting performance of the fluid is improved relative to the performance of a lubricating fluid free of the lubricant composition.

The present disclosure may also encompass compounds containing protective groups. One skilled in the art will also appreciate that compounds of the present disclosure can also be prepared with certain protecting groups that are useful for purification or storage and can be removed before use in the device to be lubricated. The protection and deprotection of functional groups is described in "Protective Groups in Organic Chemistry", edited by J. W. F. McOmie, Plenum Press (1973) and "Protective Groups in Organic Synthesis", 3rd edition, T. W. Greene and P. G. M. Wuts, Wiley-Interscience (1999).

The compounds of the present disclosure may include all stereoisomers (e.g., cis and trans isomers) and all optical isomers of disclosed compounds (e.g., R and S enantiomers), as well as racemic, diastereomeric and other mixtures of such isomers.

The compounds and/or salts of the present disclosure may exist in several tautomeric forms, including the enol and keto forms, or the imine and enamine forms, and geometric isomers and mixtures thereof. All such tautomeric forms are included within the scope of the present disclosure. Tautomers exist as mixtures of a tautomeric set in solution. In solid form, usually one tautomer predominates. Even though one tautomer may be described, the present disclosure includes all tautomers of the present compounds.

The present disclosure also includes atropisomers of the present disclosure. Atropisomers refer to compounds that may be separated into rotationally restricted isomers.

The compounds of the present disclosure may contain olefin-like double bonds. When such bonds are present, the compounds of the present disclosure may exist as cis and trans configurations and as mixtures thereof.

As used herein, the terms "oil composition," "lubrication composition," "lubricating oil composition," "lubricating oil," "lubricant composition," "fully formulated lubricant composition," and "lubricant" are considered synonymous, fully interchangeable terminology referring to the finished lubrication product comprising a major amount of a base oil plus a minor amount of an additive composition.

As used herein, the terms "additive package," "additive concentrate," and "additive composition" are considered synonymous, fully interchangeable terminology referring to the portion of the lubricating composition excluding the major amount of base oil stock mixture.

As used herein, the terms "agent" and "additive" are considered synonymous, fully interchangeable terminology referring to any single functional component of a lubricating composition, excluding the major amount of base oil stock mixture.

As used herein, the term "pitting" refers to a form of localized corrosion that leads to the creation of small holes in metal, for example, automotive gears.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Additional objects and advantages of the disclosure will be set forth in part in the description which follows, and/or may be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DETAILED DESCRIPTION

Lubricating compositions of the present invention comprise a multi-component phosphorus anti-wear system. The anti-wear system is depicted more fully below in Scheme I.

Scheme I

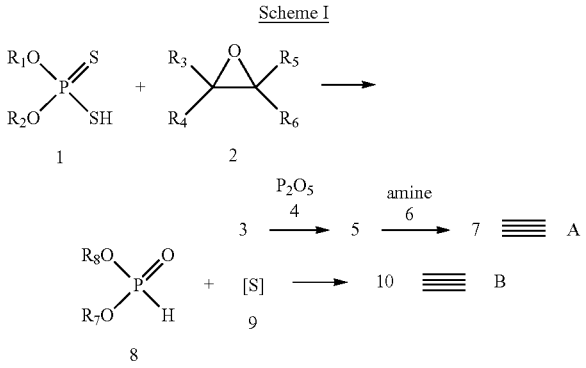

-continued

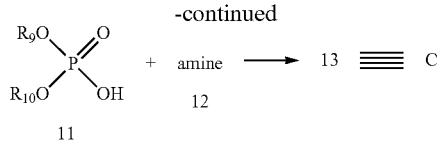

Compound A

The phosphorus anti-wear system of the present invention comprises a first phosphorus compound, A. Compound A is a reaction product made by first reacting an O,O-dihydrocarbyl phosphorodithioic acid 1 and an epoxide 2 to produce intermediate compound 3. Intermediate compound 3 is further reacted with phosphorus pentoxide 4 to provide intermediate compound 5. Intermediate compound 5 is aminated with amine 6 to provide the final reaction product 7 or A.

Suitable epoxides 2 used in the synthesis of compound A include, but are not limited to, ethylene oxide, propylene oxide, styrene oxide, alpha-methylstyrene oxide, etc., but $R_3$, $R_4$, $R_5$, and $R_6$ may independently be hydrogen or any $C_1$-$C_{30}$ hydrocarbyl group.

Suitable phosphorodithioic acids 1 used in the synthesis of compound A may be prepared by the reaction of phosphorus pentasulfide with an alcohol or a phenol. In a typical preparation, the reaction may involve 4 moles of the alcohol or phenol per mole of phosphorus pentasulfide and may be carried out within the temperature range from about 50° C. to about 200° C. For one particular example, the preparation of O,O'-di-n-hexylphosphorodithioic acid involves the reaction of phosphorus pentasulfide with 4 moles of n-hexyl alcohol at about 100° C. for about 2 hours. Hydrogen sulfide is liberated and the defined acid remains. However, R groups $R_1$ and $R_2$, provided by the alcohol, can be, independently, the same or a different $C_1$-$C_{30}$ hydrocarbyl group, but are typically butyl, lauryl, 4-methyl-2-pentanyl, etc.

Suitable amines 6 include aliphatic amines, aromatic amines, cycloaliphatic amines, heterocyclic amines, or carbocylic amines. Suitable amines 6 may have from about 4 to about 30 aliphatic carbon atoms. Further suitable amines 6 may comprise an aliphatic primary amine containing at least about 8 carbon atoms and may have the formula R"—$NH_2$, wherein R" is, for example, an aliphatic radical such as tert-octyl, tert-dodecyl, tert-tetradecyl, tert-octadecyl, cetyl, behenyl, stearyl, eicosyl, docosyl, tetracosyl, hexatriacontanyl, and pentahexacontanyl. Further suitable examples of aliphatic amines include, but are not limited to, cyclohexyl amine, n-hexylamine, dodecylamine, di-dodecylamine, tri-dodecylamine, N-methyl-octylamine, butylamine, oleyl amine, myristyl amine, N-dodecyl trimethylene diamine, aniline, o-toluidine, benzidine, phenylene diamine, N,N'-di-sec-butylphenylene diamine, beta-naphthylamine, alpha-naphthylamine, morpholine, piperazine, methane diamine, cyclopentyl amine, ethylene diamine, hexamethylene tetramine, octamethylene diamine, and N,N'-dibutylphenylene diamine.

Further, hydroxy-substituted amines may be suitable, such as but not limited to, ethanolamine, diethanolamine, triethanolamine, isopropanolamine, para-aminophenol, 4-amino-naphthol-1, 8-amino-naphthol-1, beta-aminoalizarin, 2-amino-2-ethyl-1,3-propandiol, 4-amino-4'-hydroxy-diphenyl ether, 2-amino-resorcinol, N-4-hydroxybutyl-dodecyl amine, N-2-hydroxyethyl-n-octylamine, N-2-hydroxypropyl dinonylamine, N,N-di-(3-hydroxypropyl)-tert-dodecyl amine, N-hydroxytriethoxyethyl-tert-tetradecyl amine, N-2-hydroxyethyl-tert-dodecyl amine, N-hydroxy-hexapropoxypropyl-tert-octadecyl amine, and N-5-hydroxy-pentyl di-n-decyl amine.

Compound B

In addition to compound A, the phosphorus anti-wear system of the present invention includes a second phosphorus compound, B. Compound B, or reaction product 10, is produced from the reaction of dihydrocarbyl phosphite 8 with a sulfur source 9.

Typical dihydrocarbyl phosphites 8 may include, for example, dibutyl hydrogen phosphite, dilauryl hydrogen phosphite, dioleyl phosphite etc., but $R_7$ and $R_8$ can be, independently, hydrogen or the same or a different $C_1$-$C_{30}$ hydrocarbyl group.

Various sulfur sources 9 known to those skilled in the art may be used. Typical examples may include elemental sulfur, sulfurized isobutylene, polysulfide, etc.

Compound C

In addition to compounds A and B, the phosphorus anti-wear system of the present invention includes a third phosphorus compound, C. Compound C, or reaction product 13, is produced from the reaction of hydrocarbyl acid phosphate 11 with an amine 12.

Typical hydrocarbyl acid phosphates 11 may include mono-, di-, and mixtures of mono- and dihydrocarbyl, for example, amyl acid phosphate, bis-2-ethylhexyl acid phosphate, diamyl acid phosphate, etc., but $R_9$ and $R_{10}$ can be, independently, the same or a different $C_1$-$C_{30}$ hydrocarbyl group.

Amine 12 can be the same or different than amine 6. The amine 12 includes all the various options outlined above for amine 6.

Anti-Wear Identification

The anti-wear system of the present invention provides a complex mixture of phosphorus compounds. It is possible for one skilled in the art to elucidate the complex mixture of phosphorus compounds, including the relative amounts, by using certain spectroscopic techniques. One convenient spectroscopic tool for determining the amount and type of phosphorus compounds within a lubricant composition is phosphorus-31 nuclear magnetic resonance spectroscopy ($P^{31}$ NMR). Because the different phosphorus atoms in compounds A, B, and C are found in distinct chemical environments, the $P^{31}$ NMR signature, i.e., chemical shift (in ppm), of each compound is also distinct. Furthermore, $P^{31}$ NMR spectra can provide quantitative detail about the individual phosphorus compounds present using an NMR technique known as signal integration. Accordingly, the $P^{31}$ NMR signature, including the relative intensity of the signal, as measured by integration, provides a unique spectral fingerprint that allows one skilled in the art to identify an anti-wear system having one or more components within a finished lubricant.

Optional Additive Components

In another aspect of the present disclosure, the lubricant composition comprising the phosphorus additive system described above, may be formulated into an additive composition and blended with a base oil to obtain a lubricating fluid. Such a fluid may be formulated optionally with one or more selected ingredients and additives that include, without limitation, those described herein below. Such additives may include, but are not limited to, air expulsion additives, anti-foamants (foam inhibitors), antioxidants, anti-rust additives, anti-wear additives, colorants, corrosion inhibitors, dispersants, extreme pressure agents, friction modifiers, metal deactivators, metallic detergents, organic phosphorus compounds, pour point depressants, seal swell agents, and/ or viscosity index improvers. Additives are generally described in C. V. Smalheer et al., Lubricant Additives, pages 1-11 (1967) and in U.S. Pat. No. 4,105,571, among others. The supplemental additives include those that are commercially available.

Suitable oil-soluble ashless dispersants may be selected from the group consisting of: a succinimide dispersant, a succinic ester dispersant, a succininic ester-amide dispersant, a Mannich base dispersant, phosphorylated forms thereof, boronated forms thereof, and phosphorylated and boronated forms thereof.

In selecting any of the optional additives, it may be important to ensure that the selected component(s) may be soluble or stably dispersible in the additive package and the finished lubricant composition, and may be compatible with the other components of the composition. By preference, a person skilled in the art may be expected to choose an additional optional additive or combination of additives, amounts thereof, such that the performance properties of the composition, such as the improved extreme pressure or thermal stability performance, among other properties, needed or desired, as applicable, in the overall finished composition, may not be adversely affected.

In general, the ancillary additive components may be employed in the lubricating oil in minor amounts sufficient to improve the performance characteristics and properties of the base fluid. The amounts may thus vary in accordance with such factors as the viscosity characteristics of the base fluid employed, the viscosity characteristics desired in the finished fluid, the service conditions for which the finished fluid is intended, and the performance characteristics desired in the finished fluid.

However, generally speaking, the following general concentrations (weight percent unless otherwise indicated) of the additional components in the base fluids may be illustrative.

Respective additives may be blended into selected base oils in amounts that may be sufficient to provide their expected performance. An effective amount for a specific formulation may be readily ascertained, but for illustrative purposes these general guides for representative effective amounts are provided. The amounts below are given in weight % of the fully formulated lubricating fluid.

| Component | Example Ranges 1 and 2 (wt %) | |
|---|---|---|
| Anti-wear Compound | 0-10 | 0.3-6 |
| Dispersant | 0-20 | 0.5-8 |
| EP Agent | 0-5 | 2-4 |
| Rust inhibitor | 0-1.5 | 0.05-1.0 |
| Corrosion Inhibitor | 0-5 | 0.05-3 |
| Demulsifier | 0-5 | 0.005-1.0 |
| Antifoam Agent | 0-0.5 | 0.001-0.1 |
| Diluent | 0-10 | 1.0-5.0 |
| Lubricating Base Oil | Balance | Balance |

It will be appreciated that the individual components employed may be separately blended into the base fluid or may be blended therein in various sub-combinations, if desired. Ordinarily, the particular sequence of such blending steps is not crucial. Moreover, such components may be blended in the form of separate solutions in a diluent. It may be preferable, however, to blend the additive components used in the form of a concentrate, as this simplifies the blending operations, reduces the likelihood of blending errors, and takes advantage of the compatibility and solubility characteristics afforded by the overall concentrate.

Additive concentrates may thus be formulated to contain all of the additive components and if desired, some of the base oil component, in amounts proportioned to yield finished fluid blends consistent with the concentrations described above. In most cases, the additive concentrate will contain one or more diluents such as light mineral oils, to facilitate handling and blending of the concentrate. Thus concentrates containing up to about 50 wt. % of one or more diluents or solvents may be used, provided the solvents are not present in amounts that interfere with the low and high temperature and flash point characteristics and the performance of the finished fluid composition.

Test Samples Finished fluid test samples C0-C11 and Inventive Samples A and B were prepared with individual or combinations of anti-wear compounds A, B and/or C according to Table 1. The test samples were otherwise identical. Each of the formulations contained additives typically used by one skilled in the art to formulate commercial gear oils. Only the anti-wear additives were changed to demonstrate performance benefits as seen in Table 1. In the typical gear base fluid, an extreme pressure additive was used to provide hypoid gear protection. A sulfurized isobutylene extreme pressure additive with active sulfur was used to impart extreme pressure performance. A boronated succinimide ashless dispersant was used to impart gear cleanliness. Corrosion inhibitors were used to provide protection against steel and copper attack, consisting of (carboxylic) acid and aminic steel inhibitors, and tolytriazole and thiadiazole copper passivators. Both acrylate- and silicone-type antifoam additives were used to maintain good foam protection.

Test Sample C0

Test sample C0 contained the gear package described above and the anti-wear additive amyl acid phosphate, Compound C, in an amount to provide 300 ppm of phosphorus to the finished lubricant. The total phosphorus content of the fluid was 300 ppm.

Test Sample C1

Test sample C1 contained the gear package described above and the anti-wear additive amyl acid phosphate, Compound C, in an amount to provide 525 ppm of phosphorus to the finished lubricant. The total phosphorus content of the fluid was 525 ppm.

Test Sample C2

Test sample C2 contained the gear package described above and the anti-wear additives dibutyl hydrogen phosphite, Compound B, in an amount to provide 250 ppm of phosphorus and 2-ethyl hexyl acid phosphate, Compound C, in an amount to provide 525 ppm of phosphorus. The total phosphorus content of the fluid was 775 ppm.

Test Sample C3

Test sample C3 contained the gear package described above and the anti-wear additives dibutyl hydrogen phosphite, Compound B, in an amount to provide 250 ppm of phosphorus and 2-ethyl hexyl acid phosphate, Compound C, in an amount to provide 750 ppm of phosphorus. The total phosphorus content of the fluid was 1000 ppm.

Test Sample C4

Test sample C4 contained the gear package described above and the anti-wear additives dibutyl hydrogen phosphite, Compound B, in an amount to provide 210 ppm of phosphorus and amyl acid phosphate, compound C, in an amount to provide 350 ppm of phosphorus. The total phosphorus content of the fluid was 560 ppm.

Test Sample C5

Test sample C5 contained the gear package described above and the anti-wear additive amyl acid phosphate, Compound C, in an amount to provide 1200 ppm of phosphorus. The total phosphorus content of the fluid was 1200 ppm.

Test Sample C6

Test sample C6 contained the gear package described above and the anti-wear additives dibutyl hydrogen phosphite, Compound B, in an amount to provide 450 ppm phosphorus and 2-ethyl hexyl acid phosphate, Compound C, in an amount to provide 300 ppm of phosphorus. The total phosphorus content of the fluid was 750 ppm.

Test Sample C7

Test sample C7 contained the gear package described above and anti-wear additives including, the reaction product of O,O-dihydrocarbyl phosphorodithioic acid, epoxide, phosphorus pentoxide and amine, Compound A, in an amount to provide 100 ppm of phosphorus, dibutyl hydrogen phosphite, Compound B, in an amount to provide 450 ppm of phosphorus, and amyl acid phosphate, compound C, in an amount to provide 300 ppm of phosphorus. The total phosphorus content of the fluid was 850 ppm.

Test Sample C8

Test sample C8 contained the gear package described above and anti-wear additives including, the reaction product of O,O-dihydrocarbyl phosphorodithioic acid, epoxide, phosphorus pentoxide and amine, Compound A, in an amount to provide 500 ppm of phosphorus, dibutyl hydrogen phosphite, Compound B, in an amount to provide 450 ppm of phosphorus, and amyl acid phosphate, Compound C, in an amount to provide 300 ppm of phosphorus. The total phosphorus content of the fluid was 1250 ppm.

Test Sample C9

Test sample C9 contained the gear package described above and the anti-wear additive, Compound A, a reaction product of O,O-dihydrocarbyl phosphorodithioic acid, epoxide, phosphorus pentoxide and amine in an amount to provide 1100 ppm of phosphorus. The total phosphorus content of the fluid was 1100 ppm.

Test Sample Inv A

Test sample Inv A contained the gear package described above and anti-wear additives including, the reaction product of O,O-dihydrocarbyl phosphorodithioic acid, epoxide, phosphorus pentoxide and amine, Compound A, in an amount to provide 350 ppm of phosphorus, dibutyl hydrogen phosphite, Compound B, in an amount to provide 450 ppm of phosphorus, and amyl acid phosphate, Compound C, in an amount to provide 300 ppm of phosphorus. The total phosphorus content of the fluid was 1100 ppm.

Test Sample Inv B

Test sample Inv B contained the gear package described above and anti-wear additives including, the reaction product of O,O-dihydrocarbyl phosphorodithioic acid, epoxide, phosphorus pentoxide and amine, Compound A, in an amount to provide 120 ppm of phosphorus, dibutyl hydrogen phosphite, Compound B, in an amount to provide 450 ppm of phosphorus, and amyl acid phosphate, Compound C, in an amount to provide 300 ppm of phosphorus. The total phosphorus content of the fluid was 870 ppm.

High Temperature L-37 Test

The test samples above were subjected to the High Temperature L-37 test (according to ASTM D-6121), modified to test the lubricant at 325° F. The HT L-37 is used to determine the load-carrying, wear, and extreme pressure characteristics of gear lubricants in hypoid axle assemblies under conditions of high-speed, low-torque, and low-speed, high-torque operation. The procedure's apparatus includes a rear axle assembly, an engine, a transmission, and two large dynamometers. The axle is operated for 100 minutes at 440 axle rpm, 295° F. lubricant temperature, and 9460 lb-in. of torque. The axle is then operated for 16 hours at 80 axle rpm, 325° F. lubricant temperature, and 41,800 lb-in. of torque. The pass/fail criteria require that there be no "significant" distress to the ring and pinion gears in several different wear categories, including wear, rippling, ridging, spalling and scoring.

In Table 1 below, test results show whether gear distress was identified by either "pass" or "fail" test results. Thus, "fail" indicates that significant gear distress was observed at the end of test. "EOT Fe" refers to the amount of iron detected in the test sample after completion of the test ("End of Test Iron"). When iron is present in the end of test fluid in significant amounts, it is further evidence of the gear distress and loss of anti-wear protection.

FZG Pitting Test

The test samples were also subjected to the FZG Pitting Test. The FZG Pitting Test evaluates a lubricant's resistance to pitting on special spur gears. "FZG" is the Institute for Machine Elements, Gear Research Centre, Technical University of Munich ("Forschungsstelle für Zahnräder and Getriebebau"). The FZG test rig is designed to evaluate a fluid's lubricating and wear protection properties at the interface of a loaded set of gears. The FZG pitting procedure is described in the FVA Research Project No. 2/IV dated July 1997. The gears are loaded through a torsional coupling in a back-to-back gear, close power circuit configuration according to CEC L-07-A-85 that is set to known load conditions, or stages. The gears are rotated by a variable speed electric motor, and fluid temperature is controlled by heating and/or cooling elements. The FZG pitting test is run until failure or 300 hours, whichever occurs first, under constant load, temperature, and speed. During predetermined intervals, the gear tooth faces are inspected for pitting damage. Pitting is damage to the tooth flanks of a gear where material particles break out of the surface, predominantly in the dedendum area of the tooth. "FZG Pitting Hrs," in Table 1, refers to the number of test hours achieved prior to failure. Failure is defined as a pitting area >5 $mm^2$ appearing (4% damage of a single tooth or 1% of the total load carrying surface) on the surface of the test gears. In the results below, higher numbers (number of hours) are preferred. If no significant pitting has occurred after 300 hours, the test is terminated.

TABLE 1

| Test Sample | Total Phosphorus (ppm) | A Phosphorus (ppm) | B Phosphorus (ppm) | C Phosphorus (ppm) | FZG Pitting, Hrs | Gear Distress | EOT Fe, ppm |
|---|---|---|---|---|---|---|---|
| C0 | 300 | 0 | 0 | 300 | 265 | Fail | 4500 |
| C1 | 525 | 0 | 0 | 525 | 300 | Fail | 3000 |
| C2 | 775 | 0 | 250 | 525 | n/a | Fail | 1970 |
| C3 | 1000 | 0 | 250 | 750 | n/a | Fail | 1430 |

TABLE 1-continued

| Test Sample | Total Phosphorus (ppm) | A Phosphorus (ppm) | B Phosphorus (ppm) | C Phosphorus (ppm) | FZG Pitting, Hrs | Gear Distress | EOT Fe, ppm |
|---|---|---|---|---|---|---|---|
| C4 | 560 | 0 | 210 | 350 | 300 | Fail | (broken tooth) |
| C5 | 1200 | 0 | 0 | 1200 | n/a | Fail | 728 |
| C6 | 750 | 0 | 450 | 300 | n/a | Fail | 974 |
| C7 | 850 | 100 | 450 | 300 | n/a | Fail | 974 |
| C8 | 1250 | 500 | 450 | 300 | 101 | Pass | 325 |
| C9 | 1100 | 1100 | 0 | 0 | 105 | Pass | |
| Inv A | 1100 | 350 | 450 | 300 | 305 | Pass | 275 |
| Inv B | 870 | 120 | 450 | 300 | 300 | Pass | 320 |

As shown by these examples, samples C0-C8, which contained less than 100 ppm of Compound A in spite of a broad range of total phosphorus (300 ppm to 1200 ppm total P), were not able to pass the HT L-37 test because either the hardware failed due to gear distress and/or the end-of-test (EOT) iron (Fe) levels were too high. However, Comparative Samples C1 and C4, which had a total phosphorus content of 525 and 660 ppm, passed the FZG Pitting Test by surpassing 300 hours without pitting. Comparative Sample C0 which had a total phosphorus content of only 300 ppm also failed the FZG Pitting Test, lasting only 265 hours.

Inventive samples, A and B, contained from 100-350 ppm of Compound A and 750-1100 ppm of total phosphorus, the remainder of the phosphorus provided by combinations of Compounds B and C. These two samples performed well in the HT L-37 test providing more than 16 hours without any observable gear distress in the HT L-37 and providing low amounts of iron at the end of the test. In addition, pitting performance was good with the inventive samples showing no pitting after 300 hours in the FZG pitting test.

On the other hand, Comparative Samples C9-C11 contained greater than 1100 ppm total phosphorus and greater than 350 ppm of Compound A. While these samples passed the L-37 test, the presence of too much Compound A had a negative effect on pitting performance. Pitting was observed in these samples after only about 100 hours in the FZG Pitting test.

Thus, surprisingly the inventors have discovered an optimized anti-wear system for passing both the high temperature L-37 and the FZG Pitting test. This performance is achievable by an optimized phosphorus anti-wear system that requires the selection of the presently disclosed combination of phosphorus anti-wear chemistry, including a particular combination of phosphorus levels. If too much Compound A is used, a poor pitting performance will result, too little, and the wear performance breaks down. Surprisingly, the performance is not dependent on anti-wear phosphorus level, but rather on a specific combination of phosphorus anti-wear chemistry having dithiophosphate, thiophosphate and phosphate moieties as functional groups.

It is understood that lubricant compositions and/or lubricant additives according to an embodiment of the present disclosure may exhibit robust anti-wear performance while preventing pitting.

As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

While the present disclosure has been principally demonstrated hereinabove in the examples as a gear fluid having improved wear and anti-pitting performance, it is contemplated that the benefits of the fluid are similarly applicable to other lubricating or power transmitting fluids. Included within the scope of the present disclosure may be, but not limited to, gear oils, hydraulic fluids, engine oils, heavy duty hydraulic fluids, industrial oils, power steering fluids, pump oils, tractor fluids, and universal tractor fluids. Apparatus embodiments may include, but are not limited to, gears, engines, hydraulic mechanisms, power steering devices, pumps and the like incorporating a lubricating fluid according to the present disclosure.

Other embodiments of the present disclosure will be apparent to those skilled in the art from consideration of the specification, Table 1 and practice of the embodiments disclosed and suggested herein. It is intended that the specification and examples be considered as exemplary only, with a true scope and spirit of the disclosure being indicated by the following claims.

What is claimed is:

1. A lubricant composition comprising:

(a) a first phosphorus compound formed by:
  (i) reacting an O,O-dihydrocarbyl phosphorodithioic acid with an epoxide to form a product;
  (ii) reacting the product with phosphorus pentoxide to produce an acid phosphate intermediate; and
  (iii) neutralizing at least a major portion of the intermediate with at least one first amine;

(b) a second phosphorus compound formed by reacting a sulfur source with a dihydrocarbyl phosphite;

(c) a third phosphorus compound formed by reacting an acid phosphate with at least one second amine; and (d) a base fluid in a major amount, the base fluid comprising a base oil and a sulfurized isobutylene extreme pressure additive;

wherein the first and second amine are the same or different, wherein the first phosphorus compound is present in the lubricant composition to provide between about 120 and about 350 ppm phosphorus to the lubricant composition, wherein the second phosphorus compound is present in the lubricant composition to provide between about 400 and about 500 ppm phosphorus to the lubricant composition, wherein the third phosphorus compound is present in the lubricant composition to provide up to 525 ppm phosphorus to the lubricant composition, wherein the total amount of phosphorus present in the lubricant composition is between about 820 and about 1375 ppm, wherein the lubricant composition lasts at least 300 hours without failure when subjected to the FZG Pitting Test, and wherein the lubricant composition maintains an iron level at or below 320 ppm when subjected to a High Temperature L-37 Test according to ASTM D-6121.

2. The lubricant composition of claim 1, wherein the total amount of phosphorus present in the lubricant composition is between about 870 and about 1100 ppm.

3. The lubricant composition of claim 1, wherein the 0,0-di-hydrocarbyl phosphorodithioic acid is O,O-di(4-methyl-2-pentyl) phosphorodithioic acid.

4. The lubricant composition of claim 1, wherein the 0, 0-di-hydrocarbyl phosphorodithioic acid is 0,0'-di-n-hexylphosphorodithioic acid.

5. The lubricant composition of claim 1, wherein the epoxide is selected from the group consisting of: ethylene oxide, propylene oxide, styrene oxide, alpha-methylstyrene oxide, p-methyl-styrene oxide, cyclohexene oxide, cyclopentene oxide, dodecene oxide, octadecene oxide, 2,3-butene oxide, 1,2-butene oxide, 1,2-octene oxide, 3,4-pentene oxide, and 4-phenyl-1,2-cyclohexene oxide.

6. The lubricant composition of claim 1, wherein said first amine is selected from the group consisting of: aliphatic amines, aromatic amines, cyclo-aliphatic amines, heterocyclic amines, and carboxylic amines.

7. The lubricant composition of claim 1, wherein said first amine is a mixture of $C_{11}$-$C_{14}$ tertiary alkyl primary amines.

8. The lubricant composition of claim 1, wherein the dihydrocarbyl phosphite is selected from the group consisting of dilauryl hydrogen phosphite, dibutyl hydrogen phosphite and dioleyl phosphite.

9. The lubricant composition of claim 1, wherein the dihydrocarbyl phosphite is dibutyl hydrogen phosphite.

10. The second phosphorus compound of the lubricant composition of claim 1, wherein the sulfur source is selected from the group consisting of elemental sulfur, sulfurized isobutylene, and polysulfide.

11. The lubricant composition of claim 1, wherein the acid phosphate comprises a mono-hydrocarbyl acid phosphate, a acid phosphate, or a mixture of mono-hydrocarbyl acid phosphate and di-hydrocarbyl acid phosphate.

12. The lubricant composition of claim 1, wherein the acid phosphate is selected from the group consisting of amyl acid phosphate, bis-2-ethylhexyl acid phosphate, and diamyl acid phosphate.

13. The lubricant composition of claim 1, further comprising an oil-soluble ashless dispersant selected from the group consisting of: a succinimide dispersant, a succinic ester dispersant, a succinic ester-amide dispersant, a Mannich base dispersant, phosphorylated forms thereof, and boronated forms thereof.

14. The lubricant composition of claim 1, further comprising one or more of the following: an air expulsion additive, an antioxidant, a corrosion inhibitor, a foam inhibitor, a metallic detergent, an organic phosphorus compound, a seal-swell agent, and a viscosity index improver.

15. A method of lubricating a machine part comprising lubricating said machine part with the lubricant composition of claim 1.

16. The method of claim 15, wherein said machine part comprises one or more of a gear, an axle, a differential, an engine, a crankshaft, a transmission, or a clutch.

* * * * *